US007104896B2

(12) United States Patent
Wood

(10) Patent No.: US 7,104,896 B2
(45) Date of Patent: Sep. 12, 2006

(54) OFFSET MOTOR MOUNT ADAPTOR DEVICE

(75) Inventor: Kevin Lee Wood, Flint, MI (US)

(73) Assignee: WWM Enterprises, Inc., Grand Blanc, MI (US)

( * ) Notice: Subject to any disclaimer, the term of this patent is extended or adjusted under 35 U.S.C. 154(b) by 0 days.

(21) Appl. No.: 10/458,421

(22) Filed: Jun. 11, 2003

(65) Prior Publication Data

US 2004/0259650 A1 Dec. 23, 2004

(51) Int. Cl.
*A63D 5/02* (2006.01)

(52) U.S. Cl. ..... 473/98; 473/99; 473/106

(58) Field of Classification Search ..... 473/73, 473/54, 98, 99, 106, 110, 111
See application file for complete search history.

(56) References Cited

U.S. PATENT DOCUMENTS 2,121,085 A * 6/1938 Krumholz ..... 269/249
4,071,240 A * 1/1978 Camilleri ..... 473/111
6,439,522 B1 * 8/2002 Yeh ..... 248/231.71
6,533,673 B1 * 3/2003 Wilson ..... 473/98

OTHER PUBLICATIONS

Brunswick Service Parts Catalog, Muskegon, Michigan, May 1961, pp. 57-59 and 59a.*

* cited by examiner

*Primary Examiner*—William M. Pierce
(74) *Attorney, Agent, or Firm*—Flint Patent Service; Jack E. Tubbs

(57) ABSTRACT

A novel critical supplementary apparatus, when used in conjuction with U.S. Pat. No. 6,533,673, collectively completes the sphere of practical operation of a convexo-concave bowling ball retrieving device that captures, guides, lifts and deposits in one smooth continuous flowing motion a bowling ball for subsequent discharge into a bowling ball return. U.S. Pat. No. 6,533,673 addresses the inherent lack of friction problems found in Brunswick automatic pinsetter bowling machines, models A and A2 but is unable to comply with a similar problematic lack of friction situation found in the remainder of Brunswick product line—models Factory A2 and the Jetback. The models Factory A2 and Jetback don't have adaquite clearance between the bowling ball retrieving device 1 that is mounted on the rotating ball return wheel 6 (as disclosed in U.S. Pat. No. 6,533,673) and the 1 HP motor mount shaft 19. This critical adapter device 18 circumvents this clearance obstacle by allowing for an abrupt change in the linear profile of the 1 HP motor mount shaft 19.

14 Claims, 2 Drawing Sheets

OFFSET MOTOR MOUNT ADAPTOR DEVICE

CROSS REFERENCES TO RELATED APPLICATIONS

None

STATEMENT AS TO RIGHT TO INVENTIONS MADE UNDER FEDERALLY SPONSORED RESEARCH AND DEVELOPMENT

Not Applicable

BACKGROUND OF THE INVENTION

The field of the invention is generally that of a bowling device and more specifically to an apparatus criticus, that is to say, a critical apparatus that completes the sphere of practical operation of a convexo—concave bowling ball retrieving device so fabricated as to capture, guide, lift and deposit in one smooth continuous flowing motion, a bowling ball for subsequent discharge into a bowling ball return. The present invention is an improvement in U.S. Pat. No. 6,533,673. The improvement consists of a device that allows for an abrupt change in linear profile of the 1 HP motor mount shaft used in Brunswick automatic pinsetter bowling machines, model A2 and the Jetback thereby circumventing an obstacle.

In the bowling industry there are certain mechanical malfunctions directly associated with the operation of automatic bowling machinery, these problems are most commonly referred to as spinners, yo-yos and lane stoppages. These machinery malfunctions constitute a meaningful overhead cost to the industry, these unnecessary problems result in a loss of revenue due to equipment downtime, bowler inconvenience frustration, loss of customer satisfaction and the added cost for providing the added personnel whose time would be better spent for other maintenance. U.S. Pat. No. 6,533,673 addresses all the inherent lack of friction problems found in Brunswick automatic pinsetter bowling machines, in particular models A and A2, which constitutes a major percent of the bowling market, however cannot address the problems found in the remaining Brunswick models Factory A2 and Jetbacks due to a physical clearance constraint between the bowling ball retrieving device mounted on the rotating ball wheel and the 1 HP motor mount shaft.

In reference to the Brunswick automatic pinsetter bowling machines, models A, A2, Factory A2 and jetbacks, the bowling ball automatically finds its way for deposit onto the ball return wheel. It is at this time that the malfunction called spinning and yo-yos occurs. When the large static mass of a round bowling ball, excess oil on the ball and a lack of friction meet a continuously moving ball return wheel, moving at approximately 36 R.P.M. the bowling ball will take the path of least resistance and just sit there and spin or yo-yo. It will be appreciated by those skilled in the art that to insure that a large mass bowling ball will be return routed, through automatic machinery without slippage or drag, requires a precise amount of applied friction. U.S. Pat. No. 6,533,673 addresses the lack of friction problems found in models A and A2but cannot address the problematic lack of friction found in its remaining models Factory A2 and Jetbacks due to the clearance between the ball retrieving device mounted on the rotating ball return wheel and the 1 HP motor mount shaft, there is simply not enough room. The present invention allows for the necessary clearance by providing an abrupt change in linear profile of the 1 HP motor mount shaft.

It is an observation of this inventor that U.S. Pat. No. 6,533,673 addresses the lack of friction needs of the manufactures of automatic pinsetter bowling machines, in particular models A and A2. These particular models are the most numerous in the automatic bowling market. It is another observation of this inventor that the U.S. Pat. No. 6,533,673 cannot address the remaining Brunswick models Factory A2 and Jetbacks due to a physical clearance problem. It will be appreciated by those skilled in the art that the present invention, when used in conjunction with U.S. Pat. No. 6,533,673, will allow those remaining Brunswick models Factory A2 and Jetback to operate as troublefree as the Brunswick models A and A2.

SUMMARY OF THE INVENTION

The present invention is an improvement in U.S. Pat. No. 6,533,673. The improvement consists of a one piece structure having no moving parts, that when secured to the 1 HP motor mount shaft 19 found in Brunswick automatic pinsetter bowling machines models Factory A2 and Jetback, allows for the unobstructed passage of the ball retrieving device 1 mounted on the rotating ball return wheel 6 as disclosed in U.S. Pat. No. 6,533,673. The application of the present invention used in conjunction with the afore mentioned U.S. Pat. No. 6,533,673 collectively completes the sphere of practical operation of the remainder of the Brunswick automatic pinsetter bowling machine product line.

It is an object of the present invention to provide the user a device that circumvents a clearance obstacle found in the remaining Brunswick automatic pinsetter bowling machine models Factory A2 and Jetbacks thereby allowing them the application use of U.S. Pat. No. 6,533,673 to complete the Brunswick product line.

It is another object of the invention to provide the user a device that reduces automatic bowling machinery downtime and a subsequent loss of revenue by eliminating spinners and ball hang-ups regardless of how much oil is on the ball.

It is a further object of the invention t provide the user a device that allows the automatic machinery to be operated at a lower R.P.M. thereby extending the machinery lifetime and for a savings of energy.

It is another object of the invention to provide the user a device that will eliminate the need for disposable ball kickers and other ball return aids having moveable components.

It is a further object of the invention to provide the user a more environmentally friendly device that eliminates the need for the disposal of oil soaked ball kickers and carpet strips into land fill areas.

It is another object of the invention to provide the user safer operation of automatic bowling machinery by eliminating a potential fire hazard posed by the presence of oil saturated kicker strips.

It is another object of the invention to provide the user a device that reduces the excessive wear on automatic bowling machinery such as bearings, guides, belts and drives by providing the user a means to operate the equipment at a lower R.P.M.

It is another object of the invention to provide the user a more energy efficient operating system by allowing them to operate at a lower R.P.M.

It is a further object of the invention to provide the user a device that reduces bowling ball and pin damage by allowing them to operate at a lower R.P.M.

It is another object of the invention to provide the user a device that helps speed bowling pins on the rear of the pit conveyor into the pit elevator thereby reducing the setup time of bowling pins.

It is another object of the invention to provide the user a device that eliminates expense and danger of using hazardous cleaning materials and eliminates the time required by a mechanic to clean the ball return wheel.

It is a further object of the invention to provide the user a field upgrade kit to slow down the automatic bowling machinery to facilitate smoother operation and provide longer machinery lifetime.

Further objects are implicit in the detailed descriptions which follows hereinafter (which is to be considered as exemplary of, but not specifically limiting, the present invention) and said objects will be apparent to persons skilled in the art after a careful study of the detailed descriptions which follows.

For the purpose of clarifying the nature of the present invention, one exemplary embodiment of the invention is illustrated in the hereinbelow-described figures of the accompanying drawing and is described in detail hereinafter. It is to be taken as representative of the multiple embodiments of the invention which lie within the scope of the invention.

DESCRIPTIONS OF THE PREFFFERED EMBODIMENTS

Figure 1:
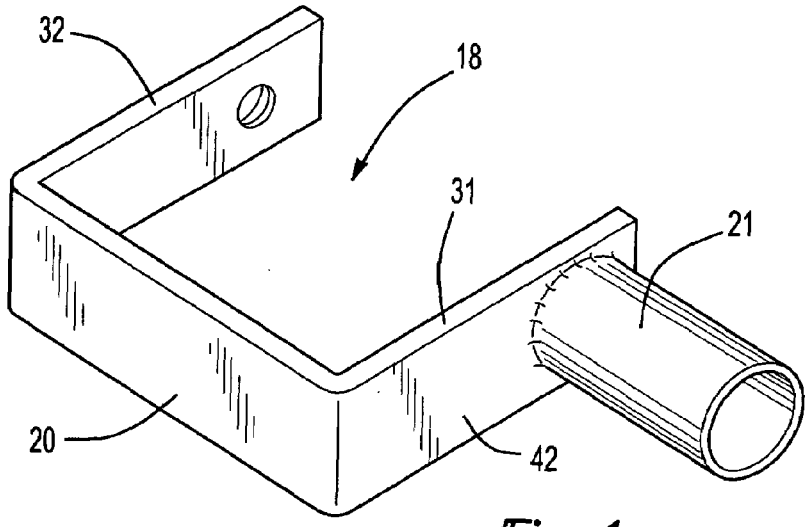
FIG. 1 is a perspective view showing one exemplary embodiment of one representative form of the invention.
Figure 2:
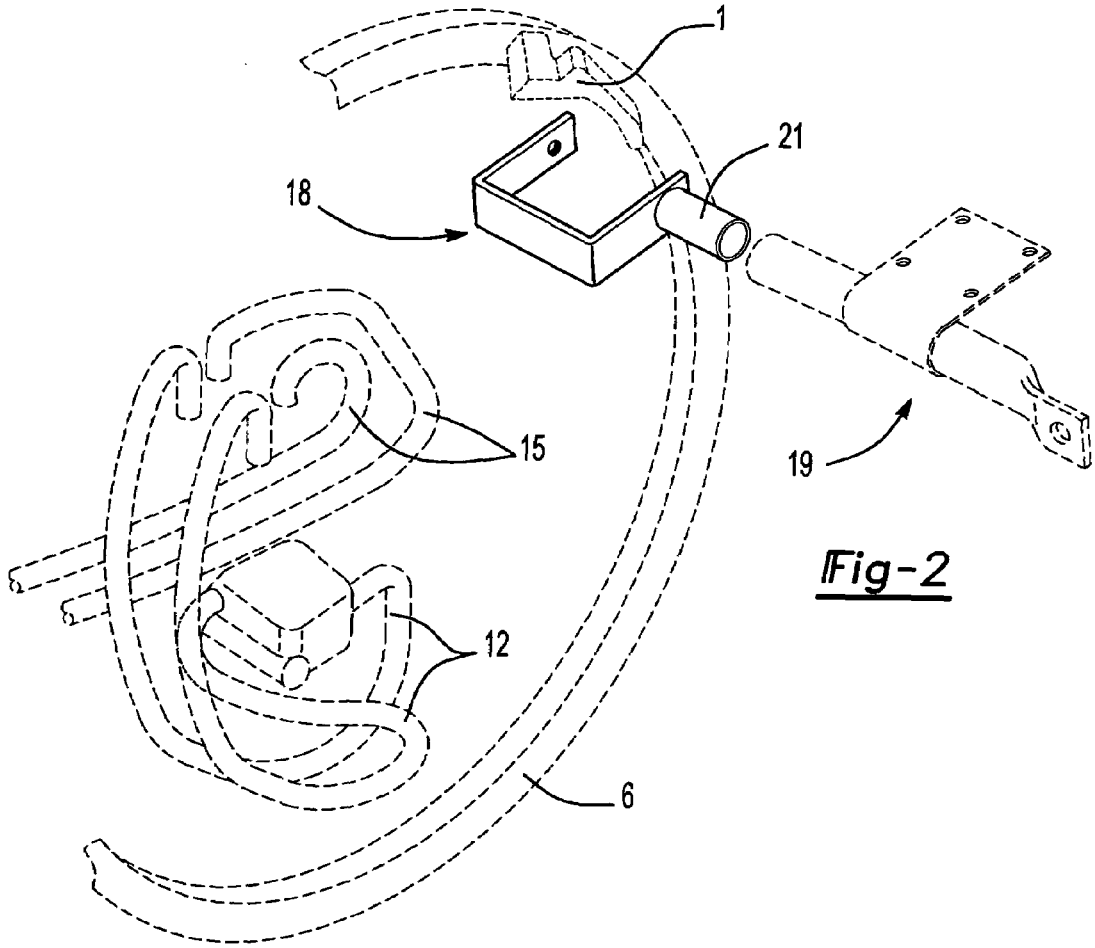
FIG. 2 is a perspective view showing one exemplary embodiment of one representative form of the invention.
Figure 3A:
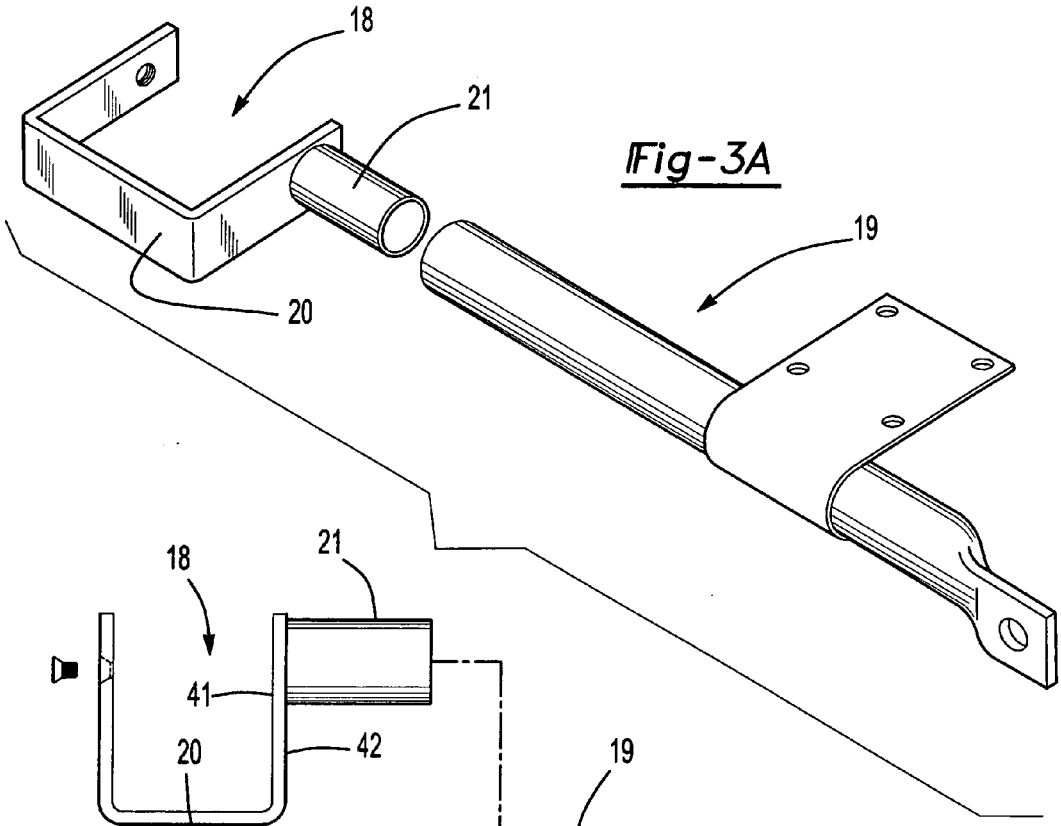
FIG. 3A is another perspective view showing one exemplary embodiment of one representative form of the invention.
Figure 3B:
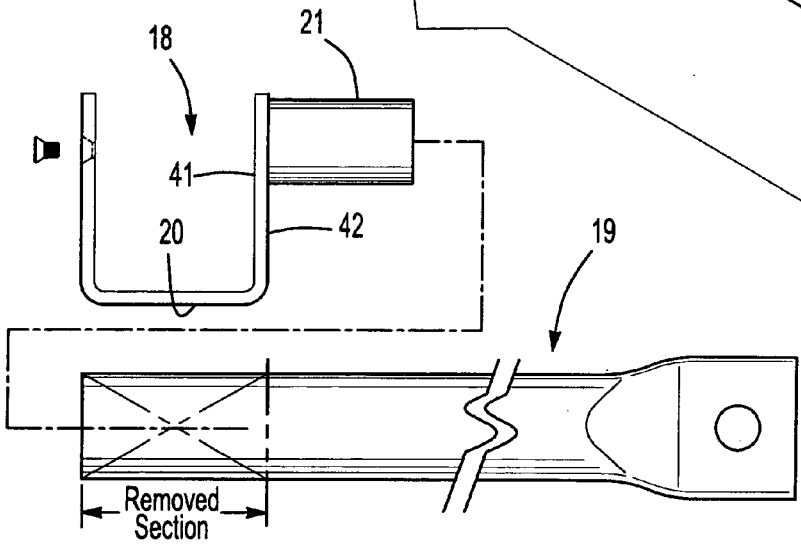
FIG. 3B is a front view showing one exemplary embodiment of the invention before a predetermined length from the motor mount shaft is removed.
Figure 3C:
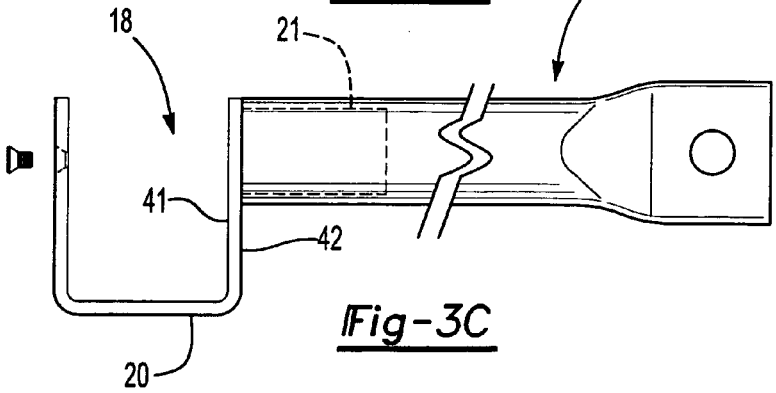
FIG. 3C is a front view showing one exemplary embodiment of the invention after a predetermined length from the motor mount shaft is removed.

Referring to FIG. 2. Offset motor mount adaptor 18 is a critical supplementary one piece apparatus that has no moving parts. Ball retriever 1 is mounted on and secured to ball return wheel 6 and circum rotates to capture, guide, lift and deposit a bowling ball for subsequent discharge into a ball return for Brunswick models A and A2. The remainder of Brunswick models Factory A2 and Jetbacks does not allow for the unobstructed passage of ball retriever 1 due to a insufficient clearance between the 1 HP motor mount shaft 19 and the ball retrieving device 1. Motor mount shaft 19 is of a particular overall length, the first end of motor mount shaft 19 is secured to Brunswick elevator assembly by a countersunk screw the second end of the motor mount shaft 19 is secured to the elevator assembly by a bolt. The motor mount shaft 19 is hollow and has an inside diameter slightly greater than the outside diameter of the shaft of the motor mount adaptor 18 (referring to FIG. 3A). A predetermined length, from the first end of motor mount shaft 19, is removed by saw, however other means of removal may also be used. Offset motor mount adaptor 18, having two ends, the first end being secured to the Brunswick elevator assembly by using the original countersunk screw, however other means of securing may also be used. The second end of the offset motor mount adaptor 18 is a shaft whose outside diameter is slightly smaller than the inside diameter of the motor mount shaft 19, shaft 21 of the offset motor mount adaptor 18 is inserted into the remaining hollow section of the motor mount shaft 19 and allowed to slide free for adjustment of final overall length, the second end of the motor mount shaft 19 is secured to the elevator assembly using the original bolt, however other means of securing can also be used. Before securing the first end of the offset motor mount adaptor 18 to the elevator assembly, rotate the offset motor mount adaptor 18 so that its offset opening will allow for free and unobstructed passage of the ball retriever device 1 as it circum rotates around—mounted on the ball wheel 6, ( referring to FIG. 2 ). With reference to FIG. 3, the overall length of the offset motor mount adaptor 18 minus the length oil the portion of shaft 21 inserted into the 1 HP motor mount shaft 19 plus the length of the remaining hollow section of motor mount shaft 19 is equal to the length of the original motor mount shaft. The assembly of FIG. 3 is secured at both ends with the offset opening giving unobstructed passage for the rotating ball retriever device 1. The overall length of motor mount shaft 19 and the radial angle of the offset motor mount adaptor 18—the juncture of the two being now secured by welding however other means of securing may also be used. Other means of providing the user the necessary parallel offset axis offset may also be used.

What is claimed is:

1. An adapter device (18) for a hollow motor mount shaft (19) of an automatic pinsetter bowling machine having a bowling ball retrieving device (1) mounted on a rotating ball return wheel (6), comprising:

a base (20) having a longitudinal axis;

a first arm (31) having first and second sides (41, 42), wherein the first and second sides are opposite each other, further wherein the base adjoins the first side and is rigidly connected to the first arm;

a second arm (32), wherein the base is rigidly connected to the second arm, further wherein the first arm and the second arm extend perpendicularly from the base in the same direction; and a shaft (21) having a longitudinal axis, wherein the shaft is rigidly connected to the second side;

wherein the longitudinal axis of the base is offset from and substantially parallel to the longitudinal axis of the shaft;

further wherein the base, the first arm and the second arm form an offset opening which allows for unobstructed passage of the bowling ball retrieving device as the ball return wheel rotates;

further wherein the shaft has an outside diameter that is smaller than the inside diameter of a hollow motor mount shaft.

2. The adapter device (18) of claim 1, further wherein the shaft is adapted to be secured to a hollow motor mount shaft.

3. An automatic pinsetter bowling machine having a hollow motor mount shaft (19) and a bowling ball retrieving device (1), comprising:

a ball return wheel (6) for moving a bowling ball along the lift rods (12) and discharging the bowling ball into the return rails (15);

an adapter device (18) including a base (20) having a longitudinal axis, a first arm (31) having first and second sides (41, 42), wherein the first and second sides are opposite each other, further wherein the base adjoins the first side and is rigidly connected to the first arm, a second arm (32), wherein the base is rigidly connected to the second arm, further wherein the first arm and the second arm extend perpendicularly from the base in the same direction, and a shaft (21) having a longitudinal axis, wherein the shaft is rigidly connected to the second side, wherein the longitudinal axis of the base is offset from the longitudinal axis of the shaft, wherein the adapter device is adapted to be secured to a hollow motor mount shaft.

4. The machine of claim 3, further wherein the base, the first arm and the second arm form an offset opening which allows for unobstructed passage of the bowling ball retrieving device as the ball return wheel rotates.

5. The machine of claim 4, wherein the longitudinal axis of the base is offset from and substantially parallel to the longitudinal axis of the shaft.

6. The machine of claim 5, further wherein the shaft has an outside diameter that is smaller than the inside diameter of the hollow motor mount shaft.

7. The machine of claim 6, further wherein the shaft is secured to the hollow motor mount shaft.

8. The machine of claim 7, further wherein the adapter device comprises a one-piece structure having no moving parts.

9. An adapter device (18) for a hollow motor mount shaft (19) of an automatic pinsetter bowling machine having a bowling ball retrieving device (1) mounted on a rotating ball return wheel (6), comprising:

a base (20) having a longitudinal axis;

a first arm (31) having first and second sides (41, 42), wherein the first and second sides are opposite each other, further wherein the base adjoins the first side and is rigidly connected to the first arm;

a second arm (32), wherein the base is rigidly connected to the second arm, further wherein the first arm and the second arm extend perpendicularly from the base in the same direction;

a shaft (21) having a longitudinal axis, wherein the shaft is rigidly connected to the second side; and means for securing the shaft to a hollow motor mount shaft;

wherein the longitudinal axis of the base is offset from and substantially parallel to the longitudinal axis of the shaft;

further wherein the base, the first arm and the second arm form an offset opening which allows for unobstructed passage of the bowling ball retrieving device as the ball return wheel rotates.

10. The adapter device (18) of claim 9, wherein the means for securing the shaft comprises a weld.

11. An adapter device (18) for a hollow motor mount shaft (19) of an automatic pinsetter bowling machine having a bowling ball retrieving device (1) mounted on a rotating ball return wheel (6), comprising:

a base (20) having a longitudinal axis;

a first arm (31) having first and second sides (41, 42), wherein the first and second sides are opposite each other, further wherein the base adjoins the first side and is rigidly connected to the first arm;

a second arm (32), wherein the base is rigidly connected to the second arm, further wherein the first arm and the second arm extend perpendicularly from the base in the same direction;

a shaft (21) having a longitudinal axis, wherein the shaft is rigidly connected to the second side;

a first end where the base is rigidly connected to the second arm; and means for securing the first end to an elevator assembly of an automatic pinsetter bowling machine;

wherein the longitudinal axis of the base is offset from and substantially parallel to the longitudinal axis of the shaft;

further wherein the base, the first arm and the second arm form an offset opening which allows for unobstructed passage of the bowling ball retrieving device as the ball return wheel rotates.

12. A method of modifying an automatic pinsetter bowling machine, comprising:

removing a predetermined length from a hollow motor mount shaft (19) of an automatic pinsetter bowling machine;

using an adapter device (18) including a base (20) having a longitudinal axis, a first arm (31) having first and second sides (41, 42), wherein the first and second sides are opposite each other, further wherein the base adjoins the first side and is rigidly connected to the first arm, a second arm (32), wherein the base is rigidly connected to the second arm, and a shaft (21) having a longitudinal axis, wherein the shaft is rigidly connected to the second side, wherein the longitudinal axis of the base is offset from the longitudinal axis of the shaft, further wherein the base, the first arm and the second arm form an offset opening, the adapter device having a first end where the base is rigidly connected to the second arm; and securing the shaft to the hollow motor mount shaft.

13. The method of claim 12, further comprising, before securing the shaft, rotating the adapter device so that the offset opening allows for unobstructed passage of a bowling ball retrieving device (1) mounted on a ball return wheel (6) as the ball return wheel rotates.

14. The method of claim 12, further comprising securing the first end to an elevator assembly of an automatic pinsetter bowling machine.

* * * * *